US005198613A

United States Patent [19]

Jenkins, Jr.

[11] Patent Number: 5,198,613

[45] Date of Patent: Mar. 30, 1993

[54] WATERPROOF DEVICE FOR HOLDING EXPLOSIVES IN A BOREHOLE AND METHOD FOR USING THE SAME

[75] Inventor: Sanford S. Jenkins, Jr., Lee's Summit, Mo.

[73] Assignee: Stemlock, Inc., Lee's Summit, Mo.

[21] Appl. No.: 650,037

[22] Filed: Feb. 4, 1991

[51] Int. Cl.[5] ..... F42B 3/00

[52] U.S. Cl. ..... 102/313; 102/312; 102/333

[58] Field of Search ..... 102/312, 313, 333, 323, 102/324

[56] References Cited

U.S. PATENT DOCUMENTS

| | | | |
|---|---|---|---|
| 921,144 | 5/1909 | McGregor | 102/333 |
| 3,151,556 | 10/1964 | Kapovich | 102/333 |
| 3,173,368 | 3/1965 | Griffith et al. | 102/333 |
| 3,760,728 | 9/1973 | McKee et al. | 102/324 |
| 4,470,352 | 9/1984 | Leperre | 102/333 |
| 4,522,125 | 6/1985 | Marz | 102/324 X |

*Primary Examiner*—Peter A. Nelson

*Attorney, Agent, or Firm*—Willian Brinks Olds Hofer Gilson & Lione

[57] ABSTRACT

This invention relates to a waterproof device for holding explosives in a borehole, a method of lining at least a portion of a borehole with an elongated, flexible, waterproof liner and a method of lining at least a portion a borehole with an elongated, flexible, waterproof liner and filling the liner with explosives.

26 Claims, 2 Drawing Sheets

WATERPROOF DEVICE FOR HOLDING EXPLOSIVES IN A BOREHOLE AND METHOD FOR USING THE SAME

BACKGROUND ART

During mining excavations in an underground mine a number of boreholes are typically dug in the end face of the mine. The boreholes are then filled with waterproofed explosives, a detonator is added to each of the boreholes and the explosives in the boreholes detonated in an appropriate sequence. The main reason waterproof explosives are used is due to water seepage that occurs into the boreholes that generally prevent the use of non waterproofed explosives. However, since non waterproofed the use of non waterproofed explosives. However, since non waterproofed explosives such as ANFO are generally such cheaper than waterproofed explosives there is clearly a need for a device and a method which would enable use of non waterproofed explosives in boreholes.

OBJECTS OF INVENTION

It is an object of this invention to provide a waterproof device for holding explosives in a borehole.

Another object is to provide a method of lining at least a portion of a borehole with an elongated, flexible, waterproof liner.

A further object is to provide a method of lining at least a portion of a borehole with an elongated, flexible, waterproof liner and filling the liner with explosives.

DISCLOSURE OF INVENTION

According to a first embodiment of this invention there is provided a waterproof device for holding explosives in a borehole, comprising:

an elongated, flexible, waterproof liner having first and second ends, the liner being capable of holding explosives within a borehole;

The first end having an aperture through which explosives can be loaded into the linear;

the second end being closed and having sufficient structural strength whereby the linear can be disposed within and along at least a portion of a borehole by locating the device at or at least partially within the entrance of the borehole and exerting force against the second end by urging means disposed at least partly within the liner, without rupturing the second end.

According to a second embodiment of this invention there is provided the device of the first embodiment further comprising a tube and the liner is disposed on and about the tube.

Typically, the device of also includes a cover disposed on and about the liner. Generally, the cover is not disposed on or about the first and second ends. Advantageously , the device also includes means to close the first end or means to close one end of the tube. Generally, the means to close one end of the tube is a cap, typically a plastic cap.

Generally, the liner comprises a flexible polymer.

Typically, the tube is a cardboard, plastic, wooden, metallic or ceramic tube.

The second end may have tape reinforcing or alternatively may include a plastic cap.

According to a third embodiment of this invention there is provided a method of lining at least a portion of a borehole with an elongated, flexible, waterproof liner, comprising:

locating the device of the first or second embodiments at or at least partially within the entrance of the borehole; and exerting force against the second end using urging means disposed at least partly within the liner so that the liner lines at least a portion of the borehole.

Typically, the urging means comprises a hose and force is exerted against the second end by blowing air through the hose.

According to a fourth embodiment of this invention there is provided a method of lining at least a portion of a borehole with an elongated, flexible, waterproof liner and filling said liner and explosives, comprising:

locating the device of the first or second embodiments at or at least partially within the entrance of the borehole; and exerting force against the second end using an urging means disposed at least partly within the liner so that the liner lines at least a portion of the borehole;

ejecting explosives against said second end from said urging means whereby said liner fills with said explosives.

Generally, the urging means comprises a hose, the explosives are initially at least partially contained within the hose and the explosives are ejected from the hose by blowing air through the hose. The hose also may contain a detonator and a primer, and, the explosives, the detonator and the primer are ejected from the hose by blowing air through the hose.

Typically, as the explosives are ejected from the hose, the hose moves outwardly from the liner through the first end.

Generally, the detonator is a non-electric detonator.

Alternatively, the detonator may an electric detonator and the liner is semiconductive.

Generally, the hose is operatively associated with an explosives feeder which feeds explosives into the hose as air is blown through the hose.

Typically the liner is a thin film (2 to 10 mm thick, preferably 2 to 6 mm thick) of a polymer such as a polyolefin ($C_2$–$C_{10}$ olefin), copolymers of different polyolefins, terpolymers of different polyolefins and blends of polyolefins. Examples of such polymers include polyethylene, polyethylene polymer with $C_3$ to $C_{10}$ alkenes, poyethylene/butadiene, polyethylene/vinyl acetate, different types of polyethylene including high density polyethylene (HDPE), low density polyethylene (LDPE), linear-low density Polyethylene (LLDPE) and mixtures and blends of different types of polyethylene with each other and other copolymers, polypropylene, copolymers of polypropylene and blends with polyethylene and polyethylene copolymers, propylene/butadiene, polyethylene polypropylene block copolymers and ethylene propylene $C_4$–$C_6$ diene terpolymers. Other suitable polymers include poly(vinylchloride), polyvinylchloride blends (see flexible polyblends listed in Table 1 page 461–463 of 'Encyclopedia of Chemical Technology', Kirk Othmer, 3rd Edition, Volume 18, John Wiley & Sons 1982, and poly(ethylene-terephatlate).

Typically, the cap is a polymer such as methacrylate including poly(methyl methacrylate), styrene acrylonitrile (SAN), SAN blends with acrylonitrile/butadene/styrene terpolymer, PVC, polypropylene, polyethylene including HDPE, LLDPE, LDPE and mixtures or blends thereof. Polypropylene polyethylene blends, copolymers and block copolymers.

One of the advantages of the devices and methods of the invention is that they enable use of non-waterproofed explosives in boreholes such as ANFO. Other advantages are that a device of the invention can be manufactured cheaply. Further the devices may be manufactured in such a way that they are light, small and convenient to store and transport, are light and convenient.

BEST MODE AND OTHER MODES FOR CARRYING OUT THE INVENTION

Figure 1:
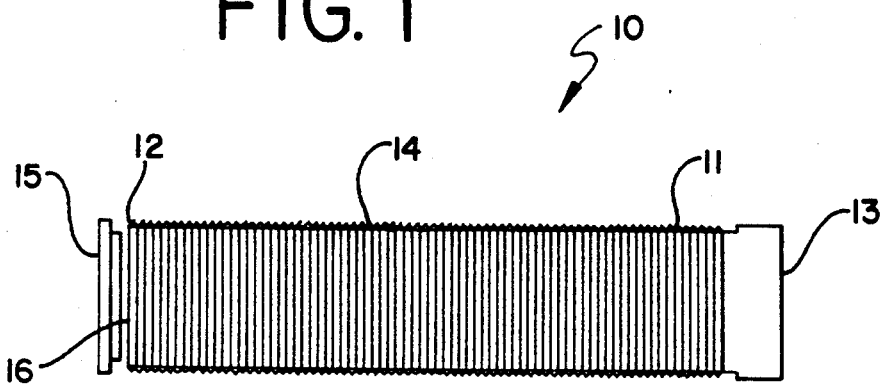
FIG. 1 is a side elevation of a cross section of a waterproof device for holding explosives in a borehole.
Figure 2:
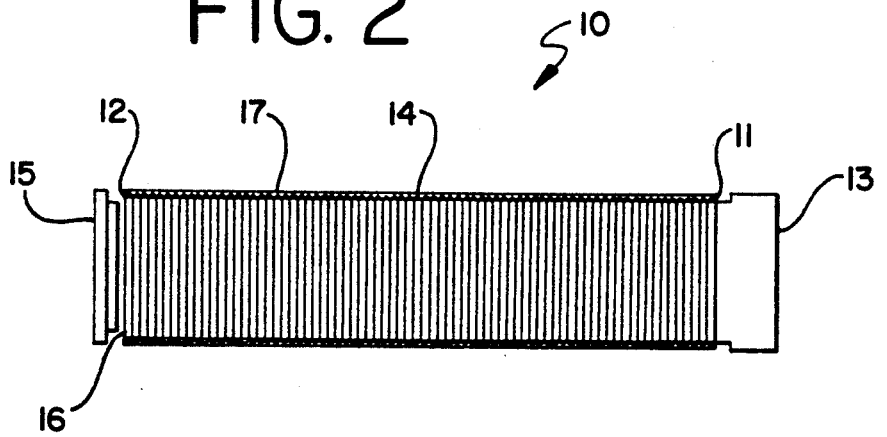
FIG. 2 is a side elevation of the waterproof device of FIG. 1 including a cover disposed on and about the liner of the device.

Referring to FIG. 1 a waterproof device 10 for holding explosives in a borehole has an elongated, flexible, waterproof liner 11 having first end 12 and second end 13. Liner 11 which is capable of holding explosives in a borehole, is typically constructed substantially from the polypropylene and is generally 2 to 6 mm thick. End 13 comprises a plastic cap made of a polymer such as styrene which has sufficient structural strength whereby liner 11 can be disposed within the along at least a portion of a borehole by locating device 10 at or at least partially within the entrance of the borehole and exerting force against end 13 by urging means (described in detail below) disposed at least partly within liner 11, without rupturing end 13. As an alternative to cap 13, end 13 may be a closed polypropylene end which is reinforced by tape. Liner 11 is disposed on and about cardboard tube 14. Device 10 includes cap 15 which fits into end 16 of tube 14. End 12 has an aperture to enable liner 11 to be disposed on and about tube 14. FIG. 2 depicts device 10 of FIG. 1 except it includes a paper cover 17 disposed on and about liner 11.

Figure 3:
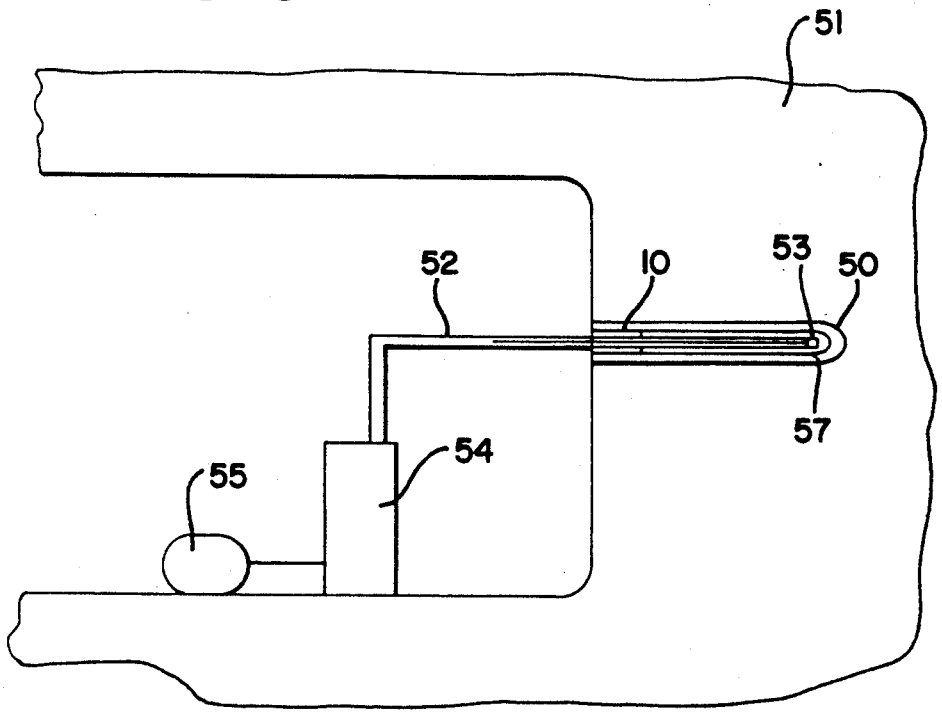
FIG. 3 is a side elevation of amine having a borehole lined with the waterproof device of FIG. 2.
Figure 4:
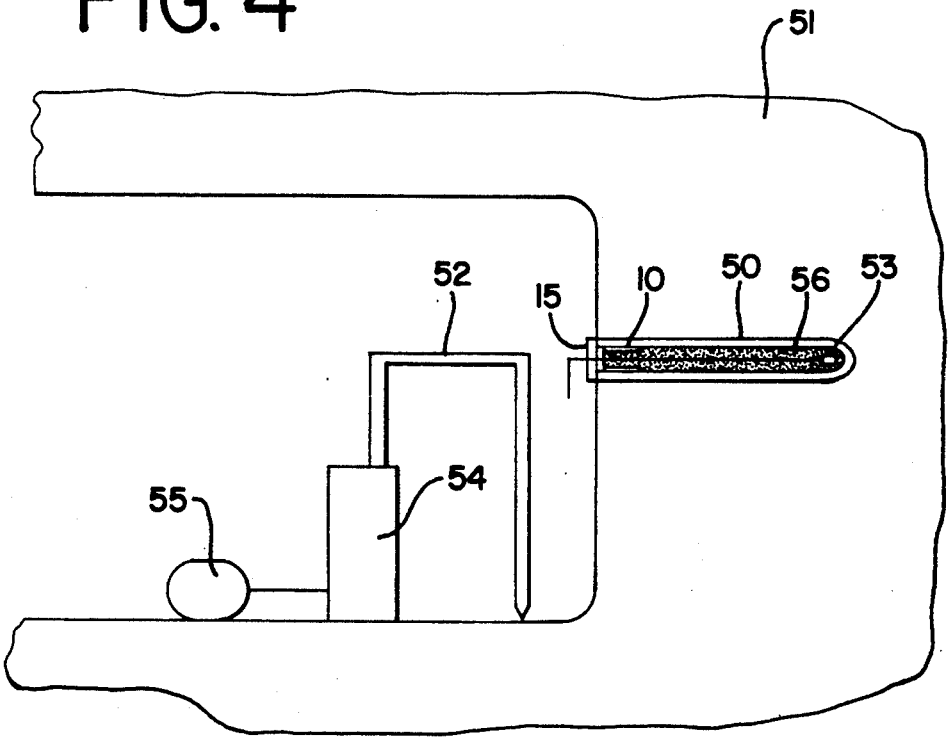
FIG. 4 is a side elevation of amine having a borehole lined with the waterproof device of FIG. 2 the device having a detonator and being filled with ANFO explosive.

Use of device 10 is now described with reference to FIGS. 3 and 4. Referring to FIG. 3 device 10 is placed in borehole 50 which is located in mine wall 51. Cap 15 is removed from device 10 and the end of hose 52 is placed within tube 14 so that it is in contact or in near contact with end 13. Hose 52 has a Nonel (Ensign-Bickford) non-electric detonator and primer 53 located within it. End 57 of hose 52 including detonator and primer 53 is pushed against cap 13 to extend the liner along borehole 50 to the back of borehole 50. Hose 52 is connected to ANFO explosive feeder 54. Compressed air pump 55 is coupled to explosives feeder 54. After locating end 57 of hose 52 within liner 11 at the back of borehole 51, air compressor 55 is turned on. The force of the compressed air through hose 52 forces detonator and primer 53 and ANFO out of the end of hose 52 and initially against end 13. As liner 11 fills with ANFO water in borehole 50 is displaced and flows out of the entrance of borehole 50 in the space between the walls at the entrance of borehole 50 and the external surface of device 10. The back force resulting on hose 52 from ANFO ejected from end 57 of hose 52 against ANFO already within liner 11 forces hose 52 back out of end 16 of tube 14 leaving liner 11 lining borehole 50 and having detonator and primer 52 therein as well as liner 11 being substantially full of ANFO 56 which ANFO is protected from water by liner 11. Cap 15 may be then placed on device 10 and ANFO 56 in liner is then detonated utilising detonator and primer 53 by known detonation procedures.

What I claim is:

1. A waterproof device for holding explosives in a borehole, comprising:
   - a tube;
   - an elongated, flexible, waterproof liner having a first, a second end, and an explosive holding portion wherein the liner is disposed on and about said tube;
   - the first end having an aperture through which explosives can be loaded into the liner;
   - the second end being closed and having sufficient strength to avoid rupturing when a force is exerted against the second end to dispose the liner within and along at least a portion of a borehole.

2. A method of lining at least a portion of a borehole with an elongated, flexible, waterproof liner and filling said liner with explosives, comprising:
   - disposing the liner an and about a tube;
   - locating the liner at or at least partially within the entrance of the borehole, wherein the liner comprises a first end, a second end, and an explosive holding portion of the borehole;
   - exerting force against the second end using an urging means disposed at least partly within the liner so that the liner lines at least a portion of the borehole; and
   - ejecting explosives against said second end from said urging means whereby said liner fills with said explosives.

3. The device of claim 1 further comprising a cover disposed on and about said liner.

4. The device of claim 3 wherein said cover is not disposed on or about said first and second ends.

5. The device of claim 1 further comprising means to close said first end.

6. The device of claim 1 wherein further comprising means to close one end of said tube.

7. The device of claim 6 when the means to close is a cap.

8. The device of claim 1 wherein the liner comprises a flexible polymer.

9. The device of claim 1 wherein said second end comprises tape reinforcing.

10. The device of claim 1 wherein said second end comprises a plastic cap.

11. A method of lining at least a portion of a borehole with an elongated, flexible, waterproof liner and filling said liner with explosives, comprising:
   - locating the liner at or at least partially within the entrance of the borehole, wherein the liner comprises a first end, a second end, and an explosive holding portion of the borehole;
   - exerting force against the second end using an urging means disposed at least partly within the liner so that the liner lines at least a portion of the borehole; and
   - ejecting explosives against said second end from said urging means whereby said liner fills with said explosives.

12. The method of claim 11 wherein the urging means comprises a hose, said explosives are initially at least partially contained within said hose and said explosives are ejected from said hose by blowing air through said hose.

13. A method of lining at least a portion of a borehole with an elongated, flexible, waterproof liner, comprising:

locating a tube with a liner disposed on and about the tube at or at least partially within the entrance of the borehole, wherein the liner comprises a first end, a second end, and an explosive holding portion;

exerting force against the second end of the liner so that the liner lines at least a portion of the borehole; and inserting an explosive into the liner.

14. The method of claim 13 wherein the urging means comprises a hose and force is exerted against said second end by pushing said hose against said second end.

15. The method of claim 2 wherein said urging means comprises a hose, said explosives are initially at least partially contained within said hose and said explosives are ejected from said hose by blowing air through said hose.

16. The method of any one of claims 12 or 15 wherein said hose is operatively associated with an explosives feeder which feeds explosives into the hose as air is blown through the hose.

17. The method of claim 11 wherein the urging means comprises a hose, said hose also contains a detonator and a primer, and, said explosives, said detonator and said primer are ejected from said hose by blowing air through said hose.

18. The method of claim 16 wherein as said explosives are ejected from said hose, said hose moves outwardly through said first end.

19. The method of claim 17 wherein as said explosives are ejected from said hose, said hose moves outwardly from said liner through said first end.

20. The method of claim 17 or 19 wherein said detonator is a non-electric detonator.

21. The method of claim 17 or 19 wherein said detonator is an electric detonator and said liner is semiconductive.

22. The method of claim 12 wherein the urging means comprises a hose, said hose also contains a detonator and a primer, and, said explosives, said detonator and said primer are ejected from said hose by blowing air through said hose.

23. The method of claim 15 wherein as said explosives are ejected from said hose, said hose moves outwardly from said liner through said first end.

24. The method of claim 22 wherein as said explosives are ejected from said hose, said hose moves outwardly from said liner through said first end.

25. The method of claim 22 or 24 wherein said detonator is a non-electric detonator.

26. The method of claim 22 or 24 wherein said detonator is an electric detonator and said liner is semiconductive.

* * * * *

UNITED STATES PATENT AND TRADEMARK OFFICE

CERTIFICATE OF CORRECTION

PATENT NO. : 5,198,613
DATED : March 30, 1993
INVENTOR(S) : Sanford S. Jenkins, Jr.

It is certified that error appears in the above-indentified patent and that said Letters Patent is hereby corrected as shown below:

In column 1, lines 16 and 17, delete "However, since non waterproofed the use of non waterproofed explosives."

In column 1, line 19, delete "such" and substitute therefor --much--.

In column 1, line 42, delete "The" and substitute therefor --the--.

In column 1, line 43, delete "linear" and substitute therefor --liner--.

In column 1, line 45, delete "linear" and substitute therefor --liner--.

In column 1, lines 57 and 58, delete "Advantageously ," and substitute therefor --Advantageously,--.

In column 2, line 15, delete the second occurrence of "and" and substitute therefor --with--.

In column 2, line 66, delete "butadene" and substitute therefor --butadiene--.

UNITED STATES PATENT AND TRADEMARK OFFICE

CERTIFICATE OF CORRECTION

PATENT NO. : 5,198,613
DATED : March 30, 1993
INVENTOR(S) : Sanford S. Jenkins, Jr.

It is certified that error appears in the above-indentified patent and that said Letters Patent is hereby corrected as shown below:

In column 3, line 31, after "from" delete "the".

In column 3, line 33, after "made" insert --out--.

In column 3, line 35, after "within" delete "the" and substitute therefor --and--.

In column 4, line 4, delete "52" and substitute therefor --53--.

Col. 4, in claim 1, line 15, after "portion" insert --,--.

Col. 4, in claim 2, line 27, after "liner" delete "an" and substitute therefor --on--.

UNITED STATES PATENT AND TRADEMARK OFFICE

CERTIFICATE OF CORRECTION

PATENT NO. : 5,198,613

DATED : March 30, 1993

INVENTOR(S) : Sanford S. Jenkins, Jr.

It is certified that error appears in the above-indentified patent and that said Letters Patent is hereby corrected as shown below:

Col. 6, in claim 22, line 15, delete "12" and substitute therefor --2--.

Signed and Sealed this

Twenty-sixth Day of April, 1994

*Attest:*

*Attesting Officer*

Bruce Lehman

BRUCE LEHMAN

*Commissioner of Patents and Trademarks*